US006435345B1

(12) United States Patent
Wang

(10) Patent No.: US 6,435,345 B1
(45) Date of Patent: Aug. 20, 2002

(54) SUPPORTED GOLF BAG

(75) Inventor: Ching Ling Wang, Walnut, CA (US)

(73) Assignee: King Power Enterprise, Inc., Walnut, CA (US)

( * ) Notice: Subject to any disclaimer, the term of this patent is extended or adjusted under 35 U.S.C. 154(b) by 0 days.

(21) Appl. No.: 09/909,069

(22) Filed: Jul. 20, 2001

(51) Int. Cl.[7] ..... A63B 55/00
(52) U.S. Cl. ..... 206/315.7; 248/96
(58) Field of Search ..... 206/315.7; 248/96

(56) References Cited

U.S. PATENT DOCUMENTS

| | | | | |
|---|---|---|---|---|
| 4,676,464 A | | 6/1987 | Reimers | |
| 4,834,235 A | | 5/1989 | Solheim et al. | |
| 4,921,192 A | | 5/1990 | Jones | |
| 5,042,654 A | | 8/1991 | Jones | |
| 5,154,377 A | | 10/1992 | Suk | |
| 5,407,155 A | * | 4/1995 | Chung | 206/315.7 X |
| RE35,684 E | | 12/1997 | Maeng | |
| 5,857,567 A | | 1/1999 | Cheng | |
| 5,901,845 A | * | 5/1999 | Cheng | 206/315.7 |
| 6,010,101 A | * | 1/2000 | Stein et al. | 206/315.7 X |
| 6,098,797 A | * | 8/2000 | Han | 206/315.3 X |
| 6,241,201 B1 | * | 6/2001 | Wang | 206/315.7 X |

* cited by examiner

*Primary Examiner*—Lee Young
*Assistant Examiner*—Tri M. Mai
(74) *Attorney, Agent, or Firm*—Charles H. Thomas

(57) ABSTRACT

A golf bag is provided with a pair of legs hinged at a rigid collar at the upper extremity of the bag. The lower end of the bag is closed by a base member that defines a flat, planar sole perpendicular to the longitudinal orientation of the bag, and also an upwardly inclined heel. An actuation plate is attached by a leaf hinge connection to the base member at the transition between the sole and heel. Knuckles on the base member and actuation plate are interleaved with each other across the width of the base member. The actuation plate protrudes outwardly beyond the body portion of the bag a distance of at least one inch. A spring wire spreader rod has a central, bight portion that is captured by a spreader hinge bracket located at the upper, outboard edge of the actuation plate. The wire spreader rod is configured with segments oriented at obtuse and reflex angles to provide improved leverage in deploying the legs. The interleaved knuckle hinge connection prevents the actuation plate from binding relative to the base member. The outward protrusion of the actuation plate reduces the torque required to deploy the legs and also provides greater stability for supporting the bag in an upright disposition.

11 Claims, 6 Drawing Sheets

SUPPORTED GOLF BAG

BACKGROUND OF THE INVENTION

1. Field of the Invention

The present invention relates to a golf bag designed to be carried by a golfer and which is self-supporting in both an upright, vertical orientation and in an inclined orientation.

2. Description of the Prior Art

Golf bags having retractable legs to allow the bag to be supported in an inclined orientation have been available for many years. The purpose of providing a golf bag with retractable supporting legs is to allow the bag to the supported in a stable orientation in which the tubular body of the bag resides at an incline relative to the surface upon which the bag is placed. The deployed legs, together with the tubular body of the bag, provide a very stable, tripod type of support in which the clubs are easily visible to the golfer and in which they can be easily pulled from and returned to the tubular body.

The biggest problem with golf bags having retractable legs is that the operating mechanisms that deploy and retract the legs frequently do not function properly. The golfer is often forced to repeatedly perform the manual actuating manipulation that is necessary to deploy or retract the legs, and to exert considerable force in doing so. This is both frustrating and annoying to the golfer. Moreover, because golfers must devote an inordinate amount of attention to ensuring that the retractable legs of their golf bag are properly deploy and returned, their concentration is impaired and their attention is distracted from performing the proper actions in executing their golf strokes.

One conventional golf bag with retractable supporting legs of this type is described in U.S. Pat. No. 5,857,567. In this device a hinged driving plate is provided at the bottom of the bag and is located entirely beneath the body of the bag. Pressure upon the upper end of the bag above the hinge plate causes the tubular body of the bag to rotate relative to the driving plate, thereby causing the elongated, configured spring to push outwardly upon retractable legs which are hinged at the top of the bag. Thus, as the body of the bag is tilted relative to the driving plate, the retractable legs are pushed out away from the body of the bag to support it in a tripod fashion.

While this system is advantageous in theory, as a practical matter it presents problems. Specifically, a very considerable amount of force is required to actuate the mechanism that pushes the legs out away from the bag due to the poor leverage that exists in the actuating mechanism. Also, frequently the driving plate does not rotate freely relative to the base at the bottom of the body of the bag, thereby resulting in binding of the hinge mechanism. A further disadvantage of the system disclosed in this patent is that the bag is not stable when positioned in a vertically upright orientation. To the contrary, it easily tips over when in this position.

SUMMARY OF THE INVENTION

The present invention provides a uniquely configured operating mechanism that reliably deploys and retracts the retractable legs of a golf bag with a minimum of effort on the part of the golfer. Furthermore, the operating mechanism of the present invention is designed to avoid the problems of binding and malfunctioning that plague conventional deployment mechanisms. In addition, the golf bag of the present invention has far greater stability when positioned upright and on end in a vertical orientation as contrasted with conventional golf bags having retractable legs.

In one broad aspect the present invention may be defined as a golf bag comprising an elongated tubular body for storage of golf equipment, a stiff base member, an actuation plate hinged to the base member, a wire spring spreader rod, and a pair of elongated retractable legs. The tubular body has a longitudinal alignment, an open upper end, and a closed lower end. The stiff base member is located at the closed end of the body and defines a sole perpendicular to the longitudinal alignment of the tubular body for supporting the body in an upright orientation. The base member also defines a heel sloping upwardly and outwardly from the sole for supporting the body in an inclined orientation. The base member includes a transverse, linear hinge interface terminating in knuckle joints at its opposing ends. The hinge interface delineates the sole and heel from each other.

The actuation plate has knuckle joints that fit in between the knuckle joints of the base member. The actuation plate is joined to the base member at the linear hinge interface and extends laterally outwardly away from the linear hinge interface and protrudes beyond the tubular body a distance of at least one inch.

The actuation plate is equipped with a leg spreader hinge bracket located outboard from the body and defining a spreader axis of rotation parallel to the linear hinge interface. The hinged ends of the legs are joined to the body at the upper end thereof and at locations directly above the protruding portion of the actuation plate. The legs have free ends that are rotatable to reside alongside the body and alternatively to project outwardly and downwardly therefrom.

The spring wire spreader rod includes a linear, central bight captured by the spreader hinge bracket and parallel to the linear hinge interface. The spreader rod also includes a pair of spreader arms extending upwardly from opposite ends of the bight. The spreader arms have lower portions that are angled upwardly and inwardly from the body and upper portions that are angled upwardly and outwardly away from the body. The spring wire spreader rod also includes transversely directed tips engaged with the legs at connections below the upper end of the body.

The invention may also be described as a golf bag comprising: a longitudinally oriented tubular body, a rigid base at the lower extremity of the tubular body, a flat stand deployment plate, a stand formed by a pair of elongated legs rotatably secured to the tubular body, a leg spreader, and an adjustable sleeve positioned at a selected location on each of the legs.

The rigid base defines a pair of downwardly disposed, flat support surfaces meeting at a transverse demarcation. A first one of the downwardly disposed flat surfaces is perpendicular to the longitudinally oriented tubular body. The other, second one of the downwardly disposed flat surfaces is inclined relative to the longitudinally oriented tubular body. This second surface is inclined upwardly and outwardly from the first one of the flat surfaces. The flat surfaces meet at a linear, transverse demarcation. A plurality of knuckle joints are formed on the base at opposing ends of the demarcation.

The flat stand deployment plate has a plurality of knuckle joints that are interleaved with the knuckle joints of the base to form a leaf hinge connection. The stand deployment plate projects outwardly beyond the second, inclined surface of the base at distance of at least one inch and has a spreader hinge coupling oriented parallel to the demarcation at its extremity remote from the demarcation.

The legs of the stand are rotatably secured to the tubular body at the upper extremity thereof, remote from the base for rotation outwardly from the tubular body and in diverging fashion away from each other. The leg spreader is comprised of a central bight captured by and rotatable relative to the spreader hinge coupling, and a pair of elongated arms extending from the bight. Each arm has a first upwardly and outwardly extending transition segment, and a second lower segment extending upwardly and inwardly from the first transition segment. The first and second segments form an obtuse angle relative to each other facing the tubular body. A third, elongated upper segment extends upwardly and outwardly from the second segment. The second and third segments of each elongated arm form a reflex angle relative to each other and facing the tubular body. The elongated arms each include a fourth tip segment extending transversely outwardly from the third segments, preferably outboard of the legs.

An adjustable sleeve is positioned at a selected location on each of the legs. Each sleeve has a transverse journal connection thereon. The journal connections receive the fourth segments of the leg spreader arms therewithin. Preferably, each sleeve includes a releaseable clamp for securing the sleeves at selected locations on the legs.

In still another aspect the invention may be considered to be a golf bag comprising: a tubular club storage body having a longitudinal orientation, a rigid base member, a pair of elongated legs, a flat leg deployment plate, a leg spreader member, and an adjustable sleeve located on each of the legs.

The tubular body has an open upper end and the closed lower end. The rigid base member is located at the closed end of the body and has a first lower face portion that is aligned perpendicular to the longitudinal orientation of the body, and a second lower face portion that is inclined upwardly and outwardly from the first lower face portion. A plurality of mutually aligned knuckles are located at the demarcation between the first and second lower face portions.

The pair of legs are hinged to the upper, open end of the body above the second, lower face portion of the base. The legs also have lower ends that are rotatable outwardly from the body in spaced separation from each other.

The flat leg deployment plate has a plurality of knuckles that fit in interleaved fashion with knuckles of the base member. The knuckles of the leg deployment plate are joined to the knuckles of the rigid base member by a knuckle hinge pin. The flat, leg deployment plate projects outwardly beyond the base a distance of at least one inch and forms a spreader hinge coupling at its extremity remote from the knuckles.

The leg spreader member has a transverse bight at its center that is captured by the spreader hinge coupling of the leg deployment plate. The spreader member also has a pair of arms projecting upwardly from the bight. Each of the arms defines a transition segment extending upwardly and outwardly from the bight, a lower segment extending upwardly and inwardly from the transmission segment at an angle thereto that is obtuse relative to the body, and a third elongated segment extending upwardly and outwardly at a reflex angle relative to the body area. The third, elongated segments of the spreader member arms extend toward the upper ends of the legs. Each arm also has a fourth, transversely directed segment at the upper end of its third segment. The fourth segments are directed in opposing transverse directions from each other.

An adjustable sleeve is located on each of the legs. Each sleeve has a transverse journal opening therethrough. The fourth segments of the spreader members are engaged in the journal openings for rotation relative to the sleeves. Preferably, releaseable clamps are provided for each of the sleeves for holding them at selected positions on the legs.

The invention may be described with greater clarity and particularity by reference to the accompanying drawings.

DESCRIPTION OF THE EMBODIMENT

Figure 1:
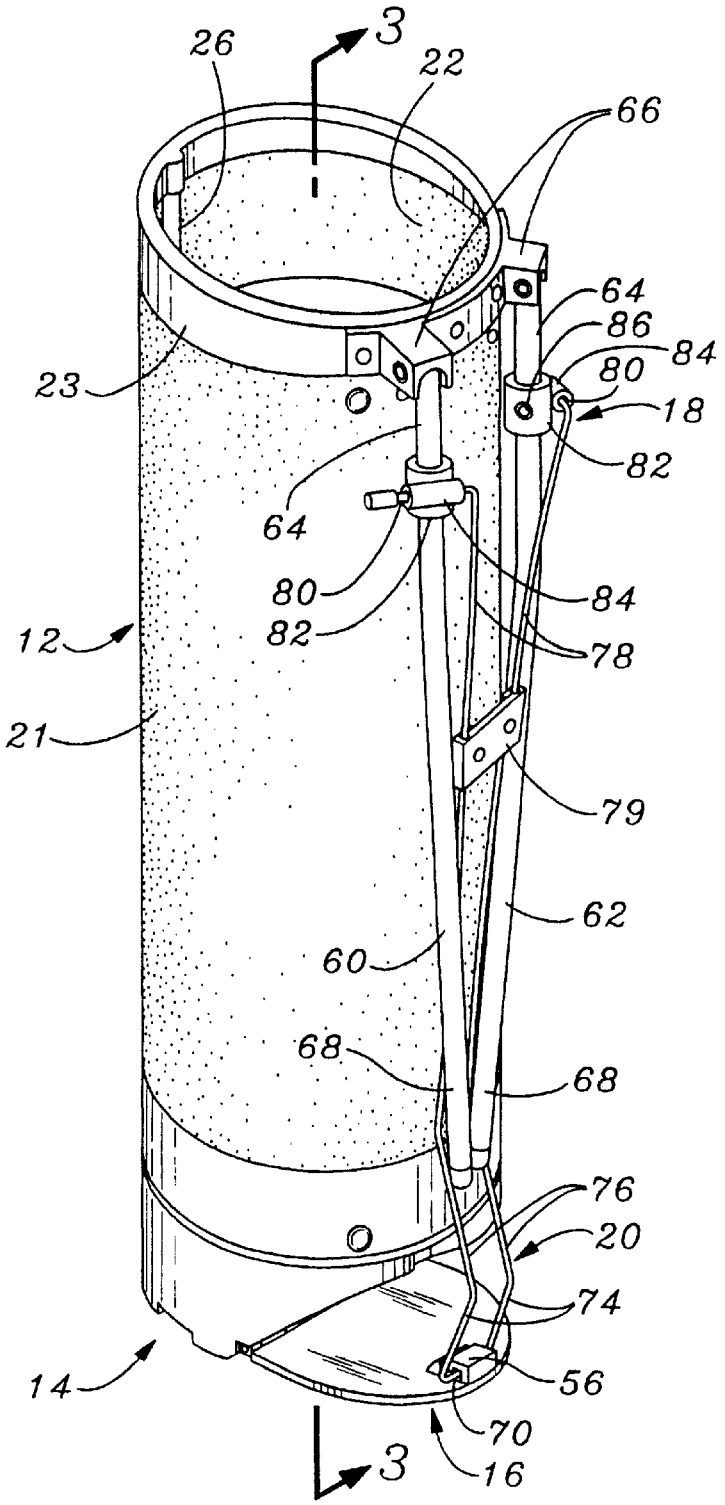
FIG. 1 is a perspective view of a preferred embodiment of a golf bag constructed according to the present invention, depicted in a fully assembled condition and with the legs retracted.

FIG. 1 illustrates a golf bag 10 constructed according to the invention. The golf bag 10 is comprised of a hollow tubular body 12 designed for storage of golf equipment, mainly golf clubs. In addition to the tubular body 12, the principal components of the golf bag 10 include a stiff base member 14 located at the closed end of the body 12, an actuation plate 16, a stand 18, and a spring wire leg spreader rod 20.

The hollow, tubular body 12 is formed of an elongated fabric wall structure 21 that surrounds and encloses an elongated cavity. At the upper end of the wall structure 21 the tubular body 12 has a stiff, plastic encircling collar 23 that delineates an open mouth to the cavity defined within the wall structure 21. The lower end of the tubular body 12 is closed by the base member 14, which is a stiff, plastic, cup-shaped lower end piece.

As in conventional golf bags, an elongated stiffening rod 26 has opposing ends that fit into sockets formed in the collar 23 and the stiff, bottom closing base member 14. The stiffening rod 26 serves to maintain the shape of the tubular body member 12 despite the flexible nature of the fabric wall 21. The tubular body member 12 is preferably between about thirty and forty inches in length and has a generally uniform cross section along its length so that it has a longitudinal alignment along a longitudinal centerline indicated at 28.

Figure 4A:
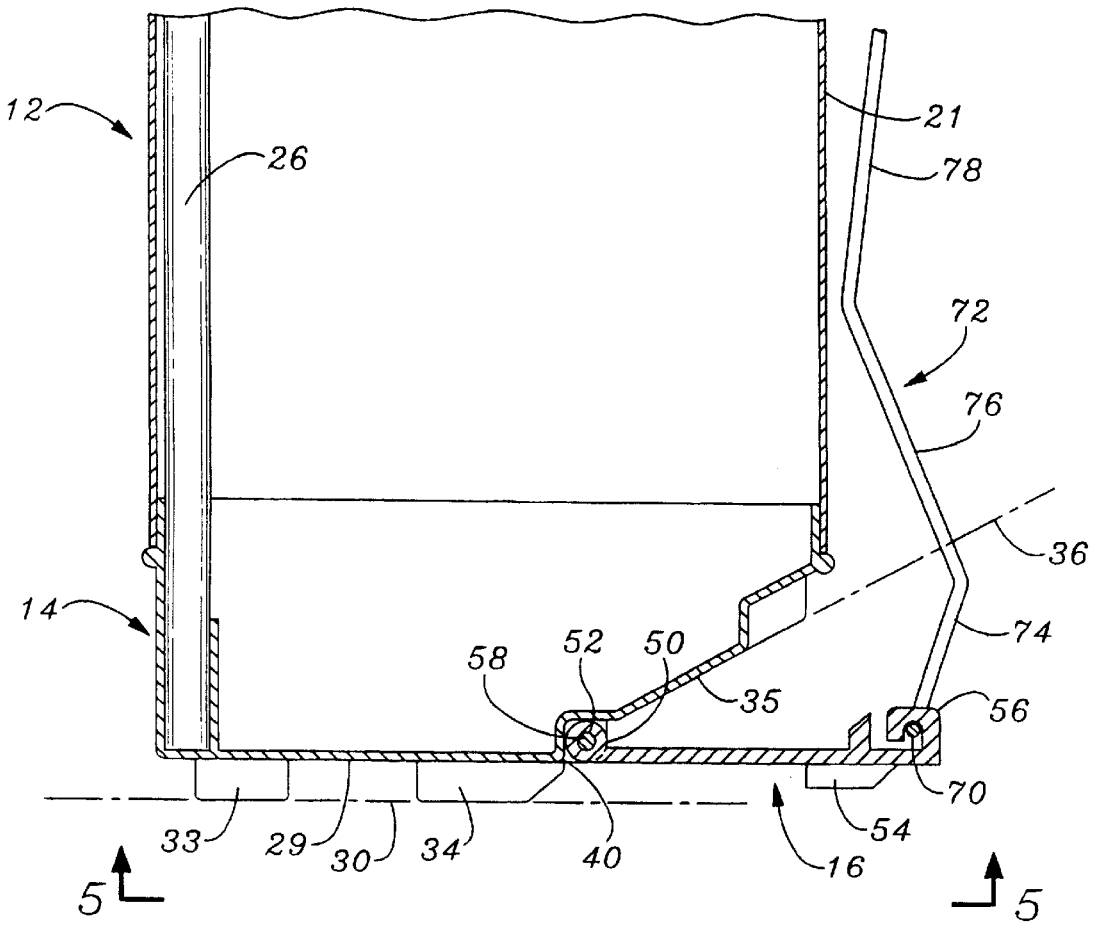
FIG. 4A is a side sectional detail showing the actuation plate and the leg spreader member as they appear when the legs of the golf bag are retracted.

As best illustrated in FIG. 4A, the base member 14 at the closed end of the body 12 has a flat sole or floor 29 with a plurality of feet 33 and 34 spaced about its periphery. The sole 29 is perpendicular to the longitudinal centerline 28 of the body member 12 and is thereby perpendicular also to the longitudinal alignment of the tubular body 12. The lower, flat contact faces of the feet 33 and 34 are parallel to and spaced beneath the sole 29. These feet contact faces define a bag upright planar support surface 30 spaced beneath and parallel to the flat floor 29. The tubular body 12 is thereby supported on the support surface 30 in an upright, generally vertical orientation when the golf bag 10 is merely rested upon its closed end in an upright disposition, as illustrated in FIG. 1.

Figure 4B:
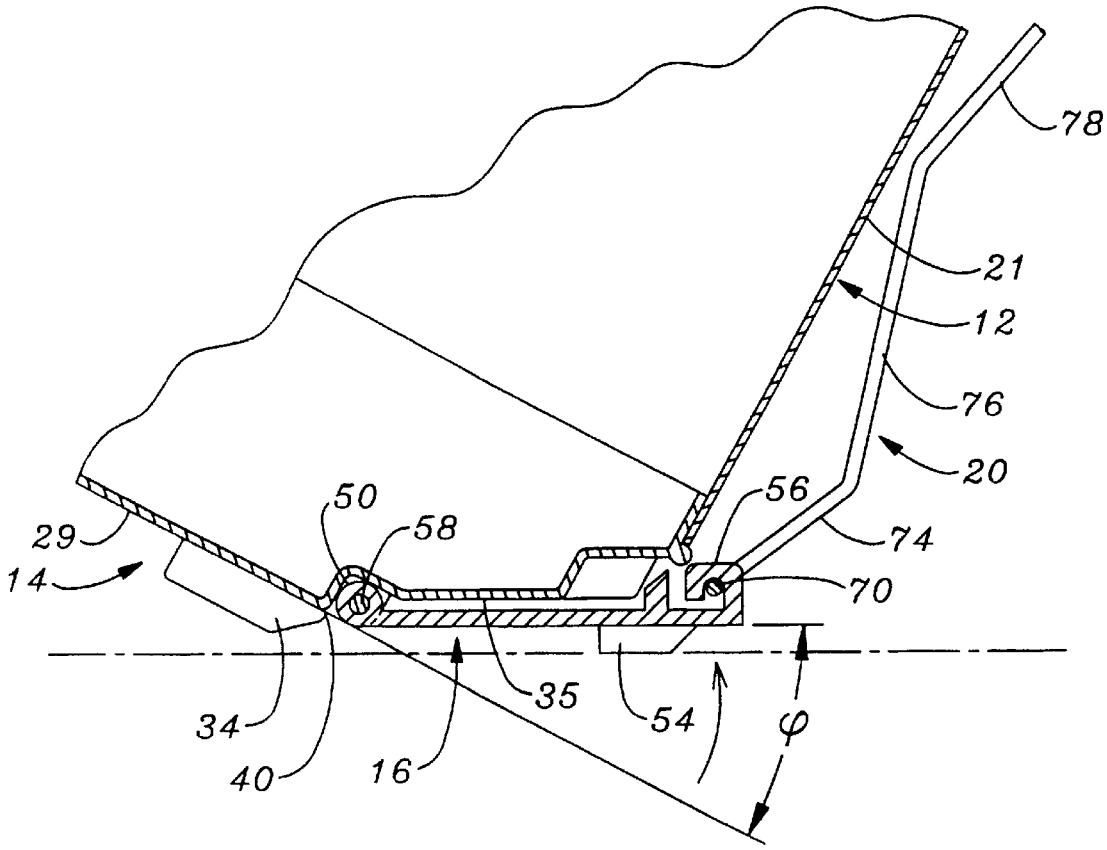
FIG. 4B is a side sectional detail showing the actuation plate and the leg spreader member as they appear when the legs of the golf bag are deployed.

The base member 14 also defines a lower planar heel surface 35 lying in a plane 36 sloping upwardly and outwardly from the sole 29 at an acute angle relative thereto, typically about twenty-eight degrees. The heel 35 of the base member 14 supports the tubular body 12 in an inclined orientation when the stand 18 is deployed, as illustrated in FIG. 4B.

The base member 14 includes a transverse, linear hinge interface 40 terminating in knuckle joints 42 and 44 at both of its opposing ends, with a plurality of interior knuckle joints 46 defined therebetween. The hinge interface 40 delineates the sole 29 and the heel 35 of the base member 14 from each other.

Figure 5:
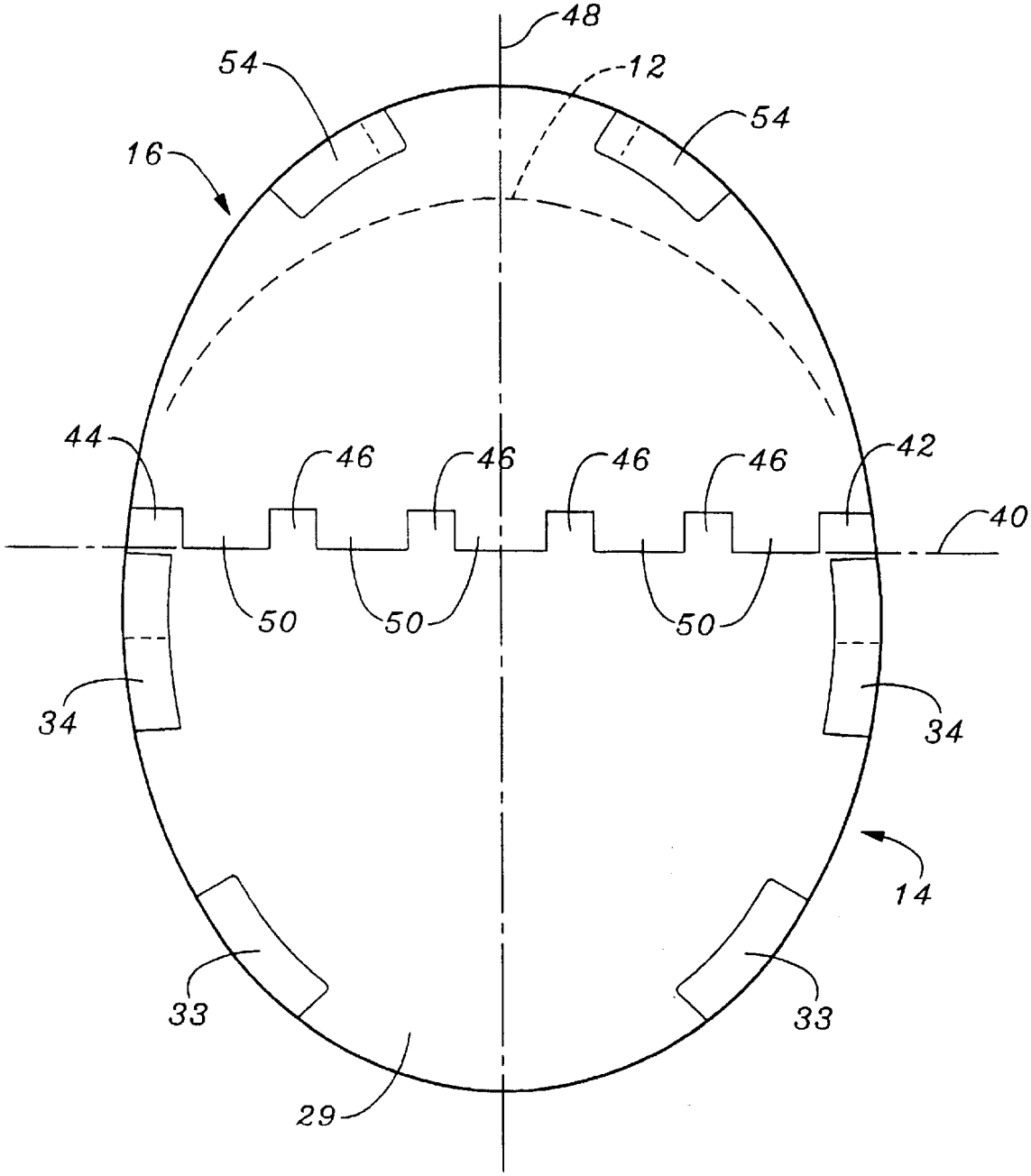
FIG. 5 is a bottom plan view taken along the lines 5—5 of FIG. 4A.

The actuation plate 16 is a flat, plastic slab shaped generally in the form of slightly less than half of an ellipse delineated by a line lying on one side of and parallel to the minor elliptical axis, as best illustrated in FIG. 5. The actuation plate 16 is preferably about one-quarter of an inch thick and functions as a stand deployment plate. The linear base of the segment of elliptical configuration of the actuation plate 16 is preferably about seven and a half inches in length, as measured along the linear hinge interface 40. The actuation plate 16 is thereby joined to the base member 14 at the linear hinge interface 40. The length of the major axis of the elliptical configuration, of which the actuation plate 16 covers slightly less than one-half the surface area, is preferably about ten and five-eighths inches, measured along the line 48 that bisects and is perpendicular to the linear hinge interface 40.

Figure 2:
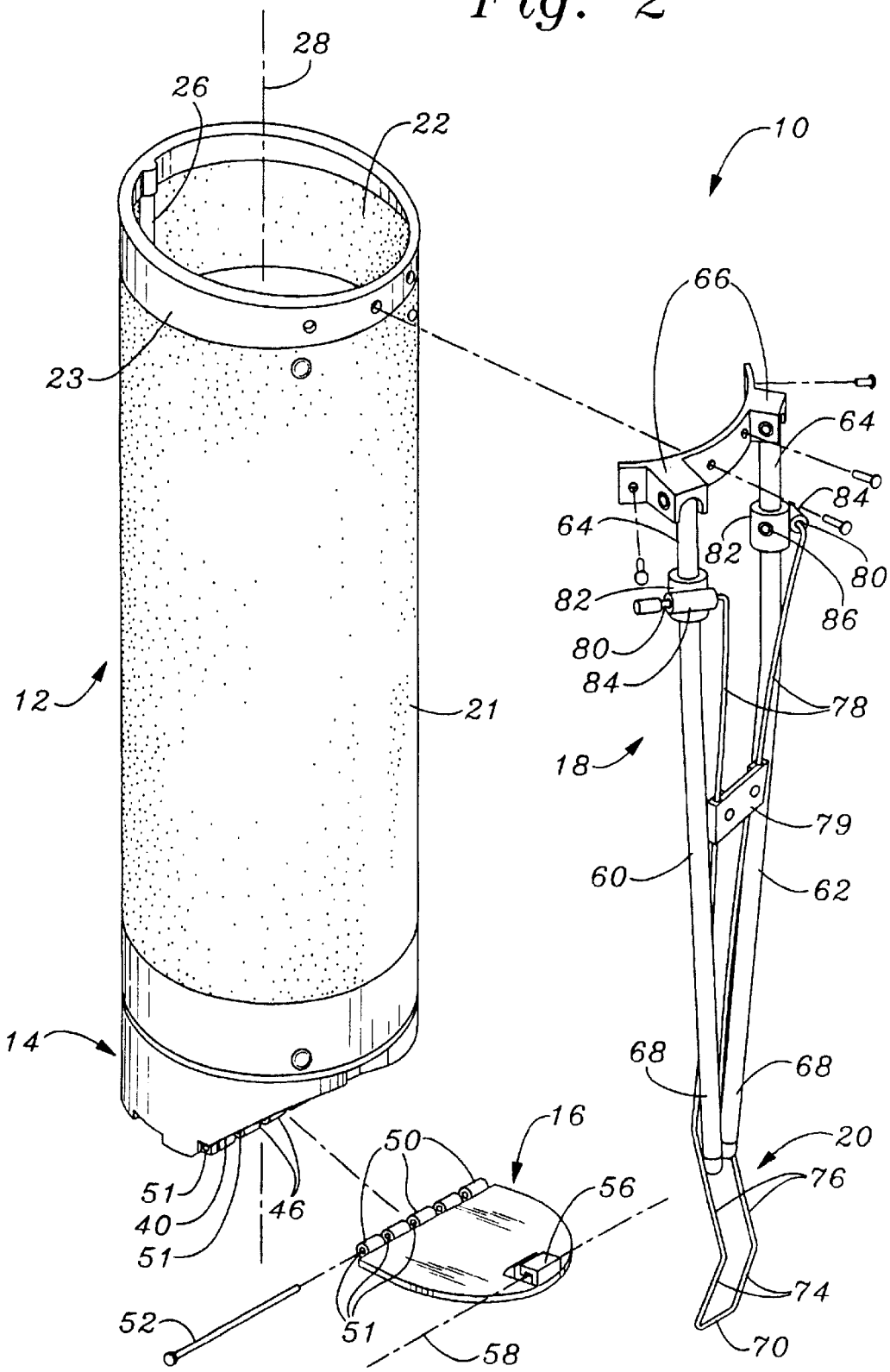
FIG. 2 is an exploded perspective view of the golf bag of FIG. 1.

The actuation plate 16 has knuckle joints 50 that fit in between the knuckle joints 42, 44, and 46 of the base member 14. All of the knuckle joints 42, 44, 46, and 50 are interleaved as illustrated in FIG. 5, and have hinge pin openings 51 defined therethrough to receive an elongated hinge pin 52, as best illustrated in FIG. 2. The bottom face of the actuation plate 16 is provided with a pair of feet 54, the lower surfaces of which reside in coplanar relationship with the surface 30 for the bag 10 when the golf bag 10 is in its vertical, upright orientation, as illustrated in FIGS. 1 and 4A.

As best illustrated in FIGS. 1 and 5, the actuation plate 16 extends laterally outwardly away from the linear hinge interface 40 and protrudes beyond the body member 12 of the golf bag 10 a distance of at least one inch. The actuation plate 16 is equipped with a spreader hinge bracket or coupling 56. The spreader hinge bracket 56 is located at the upper, outer edge of the actuation plate 16 outboard from the tubular body 12. The spreader hinge bracket 56 defines a spreader axis of rotation 58 that is parallel to and spaced laterally outwardly from the linear hinge interface 40.

Figure 3:
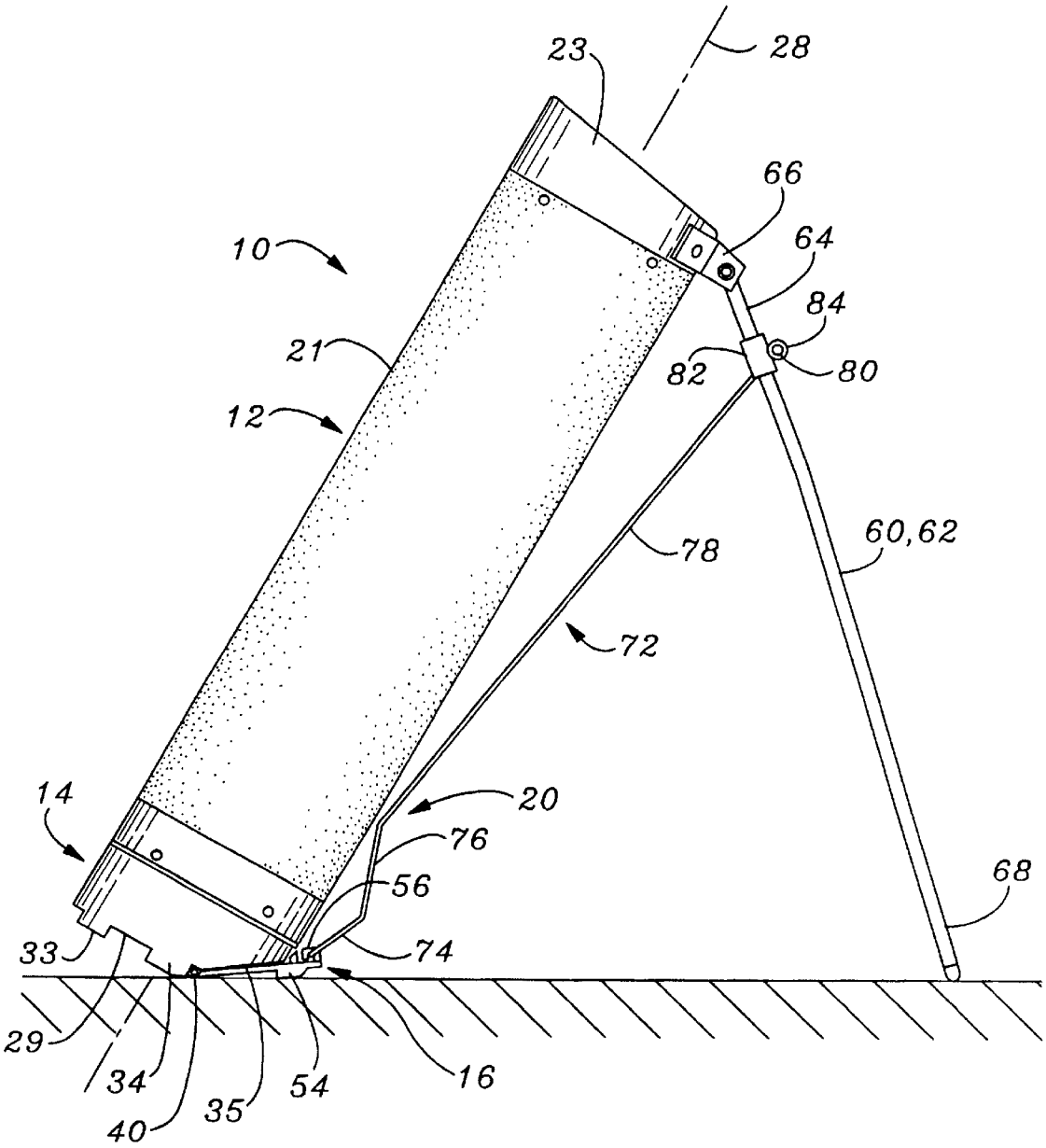
FIG. 3 is a side elevational view of the golf bag of FIG. 1 shown with the legs deployed for support.

The stand 18 is formed of a pair of elongated legs 60 and 62 having upper, hinged ends 64 that are joined to the body 12 by hinge brackets 66 on the collar 23 at locations directly above the portion of the actuation plate 16 that protrudes laterally outwardly beyond the body 12. The legs 60 and 62 also have free ends 68 that are rotatable to reside alongside the body 12, as illustrated in FIG. 1, and alternatively to project outwardly and downwardly therefrom, as illustrated in FIG. 3.

The spring wire spreader rod 20 is formed of spring steel, about one eighth of an inch in diameter. The spring wire spreader rod 20 includes a linear, central bight portion 70 that is captured by the spreader hinge bracket or coupling 56. The bight portion 70 thereby resides in an orientation parallel to the linear hinge interface 40. The leg spreader member 20 also includes a pair of arms 72 that project outwardly from the bight 70. Each of the arms 72 defines a first relatively short transition segment 74 extending upwardly and outwardly from the bight 70, a second lower segment 76, a third elongated upper segment 78 and a fourth transversely directed segment 80 at its tip.

The transition segments 74 are bent to extend perpendicularly upwardly and outwardly from the bight 70 and are each about one and three-eighths inches in length. The lower segments 76 are each about four and one-quarter inches in length and extend upwardly and inwardly from the transition segment 74 at an angle thereto that is obtuse relative to the body 12. Preferably, the obtuse angle between the segments 74 and 76 is between about 135 degrees and about 155 degrees. In the embodiment illustrated, the obtuse angle is 145 degrees.

The third, elongated, upper segments 78 of the spreader member arms 72 extend upwardly and outwardly from the lower segments 76 at a reflex angle relative to the body 12. This angle is preferably between about 188 degrees and about 218 degrees. In the embodiment illustrated, the reflex angle between the segments 76 and 78 is about 200 degrees. The upper segments 78 are each about twenty-five and a half inches in length.

A tensioning clip 79 captures the elongated segments 78 therewithin to provide a preload tension on the spring wire leg spreader rod 20. The tensioning clip 79 frictionally engages the elongated upper segments 78 and can be moved upwardly away from the lower segments 76, or closer thereto, to vary the spring tension exerted by the spring wire rod 20 tending to bias the legs 60 and 62 apart.

The legs 60 and 62 of the stand 18 are of tubular construction and have a uniform circular cross section about one half inch in outer diameter at their upper ends and also throughout their lengths. An adjustable sleeve 82 is disposed coaxially about each of the legs 60 and 62. Each of the sleeves 82 has a lug 84 that is located outboard relative to the tubular body 12. Each of the lugs 84 defines a transversely oriented journal connection therethrough.

The sleeves 80 are each equipped with a releaseable clamp in the form of a set screw 86 having an allen head recess to hold them at selected locations relative to the upper ends 64 of the legs 60 and 62. The journal connections formed through the lugs 84 on the outboard sides of the legs 60 and 62 receive the fourth, transversely oriented segments 80 of the spreader arms 72. The transversely directed tips 80 of the spreader arms 72 are disposed within and rotate relative to the journal connections through the lugs 84.

The golf bag 10 may be carried on the field of play using a conventional shoulder strap (not shown). The golf bag 10 can be placed upon a level surface in the manner illustrated in FIG. 1. When utilized in this manner the actuation or leg deployment plate 16 resides in coplanar relationship with the sole 29 of the base member 14. When the golf bag 10 is placed in an upright disposition, as illustrated in FIG. 1, the lower contact faces of the feet 34 of the base member 14 and the feet 54 of the actuation plate 16 all reside at the support surface 30.

Because the outboard portion of the actuation plate 16 upon which the spreader bracket 56 is located extends out at least one inch from the nearest surface of the tubular body 12, the base member 14 and leg spreader actuation plate 16 form a wide, very stable support for the upright tubular body 12. The wide support base formed by the base member feet 33 and 34 and the feet 54 of the actuation plate 16 prevent the golf bag 10 from tipping over due to the force of wind or light contact. When the golf bag 10 is placed upright as shown in FIG. 1, the spring force of the spring wire spreader rod 20 tends to draw the legs 60 and 62 of the stand 18 close in against the sidewall 21 of the body portion 12 of the golf bag 10.

On the other hand, oftentimes a golfer will prefer to deploy the golf bag 10 as illustrated in FIG. 3. To do so, it is merely necessary for the golfer to press lightly downwardly on the collar 23 between the leg mounting brackets 66. This light force causes the inclined heel face 35 of the bottom member 14 to rotate downwardly into contact with the actuation plate 16, as illustrated in FIG. 4B. This movement causes the spring wire rod 20 to act upon the legs 60 and 62 of the stand 18 to force the free ends 68 thereof outwardly away from the tubular body 12 and into the extended, deployed condition illustrated in FIG. 3.

Because of the very wide, interleaved knuckle hinge connection between the knuckle joints 50 of the actuation plate 16 and the knuckle joints 42, 44, and 46 of the base member 14, there is no binding or twisting of the actuation plate 16 relative to the base member 14. To the contrary, actuation of the spreader actuation plate 16 in this manner consistently and reliably deploys the legs 68 to their fully extended positions illustrated in FIG. 3.

Furthermore, since the axis of spring rod rotation 58 lies well outboard from the body portion 12 of the golf bag 10, and from the hinge interface 40, the amount of torque required to deploy the legs 60 and 62 is reduced considerably from that required by conventional golf bag stand actuating mechanisms. As previously indicated, this same feature of protrusion of the actuation plate 16 well beyond and outboard from the body portion 12 provides a greater stability to the golf bag 10 when it is in an upright vertical position, illustrated in FIG. 1. The configuration of the spreader rod arms into the several segments oriented at obtuse and reflex angles, as described, significantly improves the leverage of the spring wire spreader rod in deploying and retracting the legs.

Undoubtedly, numerous variations and modifications of the invention will become readily apparent to those familiar with golf bags having extendable and retractable legs. Accordingly, the scope of the invention should not be construed as limited to the specific embodiment depicted and described, but rather is defined in the claims appended hereto.

I claim:

1. A golf bag comprising:

a tubular body for storage of golf equipment which has a longitudinal alignment and an open upper end and a closed lower and, a stiff base member at said closed end of said body defining a sole perpendicular to said longitudinal alignment of said tubular body for supporting said body in an upright orientation, and a heel sloping upwardly and outwardly from said sole for supporting said body in an inclined orientation, and said base member includes a transverse, linear hinge interface terminating in knuckle joints at both of its opposing ends, wherein said hinge interface delineates said sole and said heel from each other, an actuation plate that has knuckle joints that fit between said knuckle joints of said base member, whereby said actuation plate is joined to said base member at said linear hinge interface and said actuation plate extends laterally outwardly away from said linear hinge interface and protrudes beyond said body a distance of at least one inch, and said actuation plate is equipped with a leg spreader hinge bracket located outboard from said body and defining a spreader axis of rotation parallel to said linear hinge interface, a pair of elongated legs having hinged ends joined to said body at said upper end thereof at locations directly above said protruding portion of said actuation plate and having free ends that are rotatable to reside alongside said body and alternatively to project outwardly and downwardly therefrom, a spring wire leg spreader rod that includes a linear central bight captured by said spreader hinge bracket and parallel to said linear hinge interface, and a pair of spreader arms extending upwardly from opposite ends of said the bight, and said spreader arms have lower portions that are angled upwardly and inwardly toward said body, upper portions that are angled upwardly and outwardly away from said body, and transversely directed tips engaged with said legs at connections therewith below said upper end of said body.

2. A golf bag according to claim 1 wherein said lower portions of said spreader arms meet said upper portions at a reflex angle facing said bag of between about 188 degrees and about 218 degrees and said tubular body is between about thirty and about forty inches in length.

3. A golf bag according to claim 2 further characterized in that said spreader arms included transition portions located immediately adjacent said bight and which form an obtuse angle with said lower portions facing said bag of between about 135 and about 155 degrees.

4. A golf bag according to claim 1 wherein said legs have a uniform circular cross section at their upper ends and further comprising an adjustable sleeve disposed coaxially about said upper end of each of said legs, each sleeve having an outboard lug defining a transversely oriented journal connection therethrough, and said sleeves are each equipped with a releaseable clamp to hold them at selected locations relative to said upper ends of said legs, and said transversely oriented tips of said spreader arms are disposed within and rotate relative to said journal connections.

5. A golf bag comprising:

a longitudinally oriented tubular body, a rigid base at the lower extremity of said tubular body, said rigid base defining a pair of downwardly disposed flat support surfaces meeting at a transverse demarcation, and a first one of said downwardly disposed flat surfaces is perpendicular to said longitudinally oriented tubular body and the other, second one of said downwardly disposed flat surfaces is inclined relative to said longitudinally oriented tubular body, upwardly and outwardly from said first one of said flat surfaces, and said flat surfaces meet at a linear transverse demarcation, and a plurality of knuckle joints are formed on said base at said opposing ends of said demarcation, a flat stand deployment plate having a plurality of knuckle joints that are interleaved with said knuckle joints of said base to form a leaf hinge connection, and said stand deployment plate projects outwardly beyond said second, inclined surface of said base a distance of at least one inch and has a spreader hinge coupling oriented parallel to said demarcation at its extremity remote from said demarcation, a stand formed by a pair of elongated legs rotatably secured to said tubular body at the upper extremity thereof remote from said base for rotation outwardly from said tubular body and in diverging fashion away from each other, and a leg spreader comprised of a central bight captured by and rotatable relative to said spreader hinge coupling, a pair of elongated arms extending from said bight, each having first upwardly and outwardly extending transition segments, second lower segments extending upwardly and inwardly from said first segments, whereby said first and second segments form an obtuse angle relative to each other facing said tubular body, third, elongated upper segments extending upwardly and outwardly from said second segments, whereby said second and third segments form a reflex angle relative to each other facing said tubular body, and fourth tip segments extending transversely outwardly from said third segments, an adjustable sleeve positioned at a selected location on each of said legs having a transverse journal connection thereon, and said journal connections receive said fourth segments of said spreader arms therewithin.

6. A golf bag according to claim 5 wherein said sleeves each include a releaseable clamp for securing said sleeves at selected locations on said legs.

7. A golf bag according to claim 5 wherein said obtuse angle is between about 135 degrees and about 155 degrees and said reflex angle is between about 188 degrees and about 218 degrees and said tubular body is between about thirty and forty inches in length.

8. A golf bag according to claim 7 wherein said first segments of said spreader arms are about one and three-eighths inches in length, said second segments of said spreader arms are about four and a quarter inches in length, and said third segments of said spreader arms are about twenty-five and a half inches in length.

9. A golf bag according to claim 5 wherein said linear transverse demarcation is at least about seven inches in length.

10. A golf bag comprising:

a tubular club storage body having a longitudinal orientation, an upper, open end and a lower, closed end, a rigid base member at said closed end of said body having a first lower face portion that is aligned perpendicular to said longitudinal orientation of said body, and a second lower face portion that is inclined upwardly and outwardly from said first lower face portion, and a plurality of aligned knuckles located at the demarcation between said first and second lower face portions, a pair of elongated legs having upper ends hinged to said upper, open end of said body above said second, lower face portion of said base, and lower ends that are rotatable outwardly from said body in spaced separation from each other, a flat leg deployment plate having a plurality of knuckles that fit in interleaved fashion with said knuckles of said base member and which are joined thereto by a knuckle hinge pin, and said leg deployment plate projects outwardly beyond said base a distance of at least one inch and forms a spreader hinge coupling at its extremity remote from said knuckles, a leg spreader member having a transverse bight at its center that is captured by said spreader hinge coupling of said leg deployment plate and also having a pair of arms projecting upwardly from said bight, each of said arms defining a transition segment extending upwardly and outwardly from said bight, a lower segment extending upwardly and inwardly from said transition segment at an angle thereto that is obtuse relative to said body, a third, elongated segment extending upwardly and outwardly at a reflex angle with respect to said body relative to said lower segment, and a fourth transversely directed segment, whereby said third, elongated segments extend toward said upper ends of said legs and said fourth segments are directed in opposing, transverse directions from each other, and an adjustable sleeve located on each of said legs, each sleeve having a transverse journal opening therethrough, and said fourth segments of said spreader members are engaged in said journal openings for rotation relative to said sleeves.

11. A golf bag according to claim 10 further comprising clamps for each of said sleeves for holding said sleeves at selected positions on said legs.

* * * * *